United States Patent [19]

Csutor

[11] 4,131,196

[45] Dec. 26, 1978

[54] ICE SKATE CARRYING CASE WITH EXTERIOR END WALL SKATE SUPPORT

[76] Inventor: Frank Csutor, 408 Jefferson Ave., Bristol, Pa. 19007

[21] Appl. No.: 751,940

[22] Filed: Dec. 17, 1976

Related U.S. Application Data

[62] Division of Ser. No. 567,588, Apr. 14, 1975, Pat. No. 4,021,054.

[51] Int. Cl.[2] ..... A65D 85/18

[52] U.S. Cl. ..... 206/278; 272/70; 206/315 R; 190/42; 224/45 R; 280/11.37 R

[58] Field of Search ..... 272/144, 146, 70; 224/45 R; 280/11.37 E, 11.37 R, 11.37 J, 7.13, 11.12, 11.3, 11.38; 46/2; 190/42; 217/17, 18, 27, 30, 34, 35, 36, 52, 53, 5; 206/315, 549, 278, 315, 216

[56] References Cited

U.S. PATENT DOCUMENTS

| | | | |
|---|---|---|---|
| 879,855 | 2/1908 | Cronbaugh | 217/36 |
| 1,210,224 | 12/1916 | Silk | 280/11.38 |
| 1,310,137 | 7/1919 | Sadowsky | 280/11.38 |
| 2,082,667 | 6/1937 | Vanderveld | 217/10 |

FOREIGN PATENT DOCUMENTS

| | | | |
|---|---|---|---|
| 108943 | 8/1917 | United Kingdom | 217/5 |

*Primary Examiner*—Anton O. Oechsle
*Assistant Examiner*—T. Brown
*Attorney, Agent, or Firm*—Albert Sperry; Frederick A. Zoda; John J. Kane

[57] ABSTRACT

A case for carrying ice skates in the form of a carrying container of rectangular box-like configuration having side end and bottom walls and a lid. The bottom wall of the interior of the container is provided with a pair of spaced apart rails which extend along the length of the bottom wall thereof. The space between the rails is adapted to freely receive the blade of an ice skate when the sole of the skate boot is supported on the rails. The height of the rails such that the skate blade is wholly out of contact with the bottom wall. At least one of the end walls is provided with an exterior groove which extends from the bottom wall to the lid of the container. The groove is of a width and depth for receiving and disposing the blade of an ice skate within and wholly out of contact with the side and bottom of the groove when the sole of the skate boot is supported on the end wall, thereby aiding a skater in putting on and/or taking off his ice skates.

2 Claims, 18 Drawing Figures

ICE SKATE CARRYING CASE WITH EXTERIOR END WALL SKATE SUPPORT

This is a division of application Ser. No. 567,588, filed Apr. 14, 1975, now Patent No. 4,021,054 issued May 3, 1977.

There is disclosed a carrying case for ice skates and for related accessories, taking the form of a rectangular box having a handle and a hinged lid, the interior of which has side-by-side supports grooved or slotted correspondingly to the above mentioned aid, to support in protective fashion a pair of ice skates. The lid may be compartmented to receive various accessories such as a first-aid kit, spare laces, food items, matches, etc. At one end, the carrying case is exteriorly formed with a wall that is slotted or grooved correspondingly to the lacing aid, in such fashion as to convert the carrying case itself to a lacing aid, by turning it on end with the slotted portion extended upwardly. With the carrying case, there is disclosed a pair of blocks detachably connected thereto, and adapted to be disposed upon a floor to support the skater on one foot after one skate has been put on and while the other skate boot is being laced.

BACKGROUND OF INVENTION

1. Field of Invention

The invention pertains, generally, to the art of ice skating, and in a more particular sense to aids and accessories for putting on ice skates, taking them off, exercising the muscles needed in ice skating, training oneself in particular aspects of ice skating, and the storage and carrying of ice skates.

2. Description of the Prior Art

With respect to aids for putting on and taking off skates, the prior art has therefore, so far as is known, offered nothing particularly significant in this respect.

The prior art has, further, also been notably lacking in the development of carrying cases that are designed specifically for the storage and transporation of ice skates, in such fashion as to protect the skates, while at the same time providing means for also carrying any of a wide variety of accessories that may be used by the skater, and while also providing means to facilitate one's putting on or taking off the skates at the rink or other skating location.

Prior art known to me is as follows:

A. R. Anderson, 1,671,096;

P. G. Cole, 1,992,291;

H. C. Ehrmantraut, 3,559,986;

E. S. Rucks, 3,582,067.

Before proceeding to a brief summary of the invention and thereafter to a detailed description thereof, it may be appropriate to note that the problems leading to conception and development of the present invention have apparently heretofore resisted solution or any serious attempts at solution. For example, a person of greater than normal girth has considerable difficulty in lacing up his or her skate boots, due to the fact that normally, one must stoop down to or bend over to the floor surface on which the skate is supported, a function which may not be difficult for slim individuals or young persons but which becomes rather difficult for those who are more portly or who may be older and hence less supple. The inconvenience and distinct discomfort suffered by individuals having these characteristics is real to them, and in the crowded areas extending about skating rinks, they find considerable difficulty in performing this normally simple function.

As regards carrying cases, the problem exists in that ice skates are carried to and from the point of use thereof in a haphazard fashion, heretofore. They are often carried in a fully unprotected state, and in a manner in which proper preservation of the boots is not assured and undesired stresses are placed thereon. Further, the prior art has not provided any single device or means for properly transporting ice skates, that at the same time will afford proper of a wide variety of skaters' accessories. Further, the desirability for adapting a carrying case for ice skates for facilitating one's putting on or taking off the skates has not been fully appreciated heretofore.

Summarized briefly, the invention may be generally described as being in the category of aids, accessories, and training devices for ice skaters. In a more particular sense, the invention comprises, basically, a rectangular member, having a flat top surface approximately coextensive in length with a skater's boot, said top surface being provided longitudinally and centrally thereof with a deep slot the width and depth of which is proportioned to receive the blade, sheathed in a protective guard, so that one may conveniently lace or unlace his boot while it is supported in an elevated position above a floor surface. The device, further, is well adapted for serving as a storage rack for ice skates.

Summarized further, the invention also includes a carrying case having parallel pairs of supporting rails in its bottom adapted to receive ice skates in such fashion as to prevent them from being damaged, or otherwise subjected to undesired flexure, abrasion, or strains while being carried. The case is also adapted to receive a plurality of small accessories or the like, and most importantly, is formed at one end with an exterior deep slot which, as in the other forms of the invention, has the capability of receiving the blade of the ice skate, again to facilitate the lacing and unlacing of the boot.

DESCRIPTION OF THE PREFERRED EMBODIMENT

Figure 1:
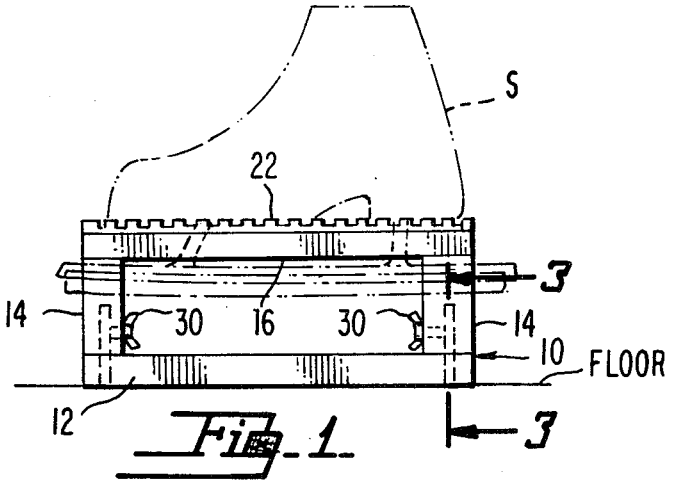
FIG. 1 is a side elevational view of a skater's aid constructed according to the present invention, an ice skate being shown in chain-dotted lines as it appears when supported upon the aid.

In FIGS. 1–6, there is illustrated a skater's aid generally designated 10, including a flat, rectangular base 12 formed of any suitable, strong, rigid stock fixedly, permanently secured at its opposite ends to like, upstanding, transversely disposed, rigidly constituted end walls 14 permanently, rigidly secured to the opposite extremities of a pair of like, flat, rigidly formed top plates 16.

Formed in the respective end walls 14, medially between the opposite side edges thereof, are upwardly opening rectangular notches 18, communicating with the space 20 defined between top plates 16 to provide an upwardly opening slot extending the full length of the device and opening upon the opposite ends thereof to receive a blade B, protectively sheathed by a blade guard G, when the boot of an ice skate S is supported upon corrugated, protective pads 22 secured to the top surface of the respective plates 16 and formed of soft rubber or the like.

Figure 2:
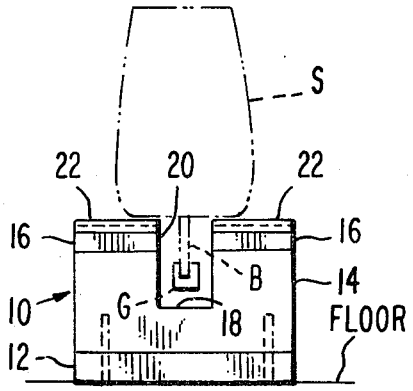
FIG. 2 is an elevational view of the skater's aid, as seen from the right of FIG. 1, the ice skate again being shown in dotted outline.
Figure 3:
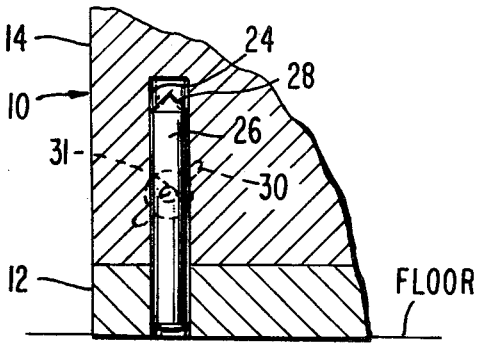
FIG. 3 is an enlarged, fragmentary, detail sectional view substantially on line 3—3 of FIG. 1, with a supporting pin being shown in retracted position as it would be when the device is used on the floor surface.
Figure 4:
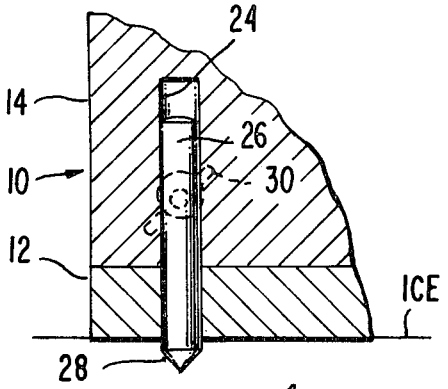
FIG. 4 is a view like FIG. 3 in which the pin has been reversed and extended, for use of the device on ice.

The device shown in FIGS. 1–6 is particularly adapted for use on a floor surface in the manner shown in FIGS. 1–3. As shown in FIG. 3, there is provided, near the four corners of the rectangular base, deep recesses 24 opening upon the bottom of the device through base 12 thereof, said recesses being extended continuously through the base into the respective end walls 14.

Recesses 24 receive metal pins 26 having points 28 at one end and engageable by wing bolts 30 threadedly engaged in openings 31 formed in end walls 14, to retain the pins either in retracted positions shown in FIG. 3 or in extended positions (see FIG. 4) in which the points 28 project below the base 12 to engage in the surface of the ice. When the skaters' aid is used off the ice, the pins would be retracted as in FIG. 3; when the device is used on the ice, it may be desired to extend the pins as in FIG. 4 to prevent the device from slipping while the skates are being put on or are being taken off. In either instance, the set screw means defined by wing bolts 30 is operable to retain the pins in desired position.

Figure 5:
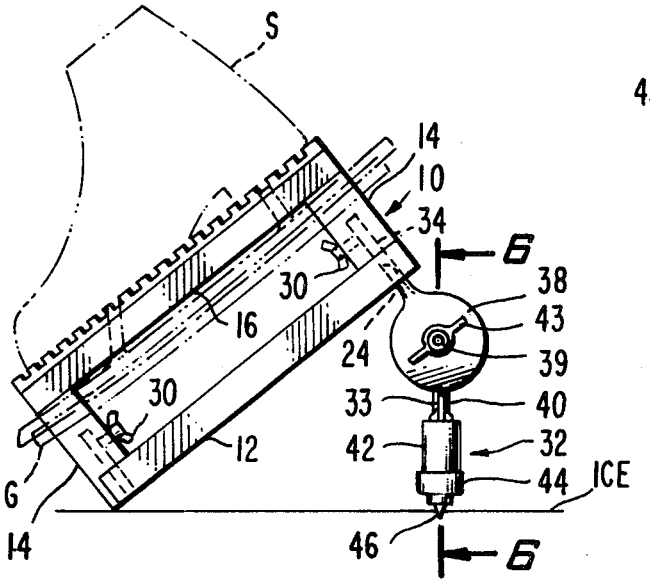
FIG. 5 is a side elevational view of the skater's aid with two of the pins being removed and with angularly adjustable and extensible supporting legs being substituted therefor, to support the skater's aid in an inclined position for use as a training and exercising device.

Referring to FIG. 5, the skater's aid 10 is also usable as a training accessory, generally for more advanced skaters, for the purpose of strengthening leg muscles to an extent such as will support the skater in crouched positions, or during spins. The device, in these circumstances, is also usable to advantage in training the skater in maintaining proper balance when one or both knees are bent.

Figure 6:
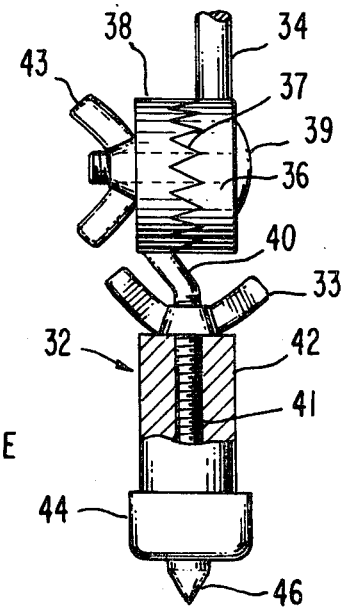
FIG. 6 is an enlarged view, substantially on line 6—6 of FIG. 5, of one of the adjustable supporting legs.

To this end, the device may be used on ice in the manner shown in FIGS. 5 and 6, with a specially designed pair of supporting legs 32. Each of these includes, at its upper end, an elongated pin 32 adapted to be received in recesses 24 in substitution for pins 26 normally disposed with said recesses. The elongated pins 34 are fixedly but removably retained in the recesses by the wing bolts 30, and project below one end of the base 12 as shown in FIG. 6. At their lower ends, pins 34 are integral or otherwise made rigid with circular discs 30 one face of which is formed with radial teeth 37 meshing with complementary teeth formed on one face of discs 33, that are integral with downwardly extending studs 40. The lower ends of studs 40 are threaded and are non-rotatably seated in smooth-walled, upwardly opening, axial recesses 41 of tubular support legs 42, to the lower end of which caps 44 are fixedly secured, said caps being provided with downwardly projecting pins 46 engageable in the ice. A wing nut 33 is threadedly engaged with each stud 40, and bears against the top surface of leg 42. Thus, by selective rotation of wing nut 33, stud 40 is adjustable upwardly or downwardly within leg 42.

The angular relationship of pin 34 and stud 40 of device 32 can be adjustably varied, and can be fixedly retained in any selected position of adjustment, through the provision of the discs 36, 38. The discs have smooth-walled, registering center openings, receiving a bolt 39, and a wing nut 43 engages the bolt, to clamp the discs together in selected positions of relative rotary adjustment.

In use of the device shown in FIGS. 5 and 6, as previously noted, two of the pins 26 are removed, and the adjustable support legs 32 are substituted for the removed pins. As a result, the skater's aid 10 is supported in a selected position of tiltable adjustment as shown, for example, in FIG. 5. Obviously, the degree of tilt can be varied according to the desires of the user, through the medium of axial adjustment of stud 40 in the tubular leg 42. As the angle of tilt is changed, so too must the angular adjustment of pin 34 in relation to stud 40 be changed.

The device illustrated in FIGS. 5 and 6 can be used to advantage by a skater, particularly a more advanced skater, in that he can stand on the tilted device with one skate positioned thereon in the manner shown in FIG. 3 with knees bent, to strengthen the leg muscles, and to practice the retention of perfect balance while in various skating positions. The device as used in FIGS. 5 and 6 is particularly advantageous for those skaters who seek to develop improved free skating or figure skating techniques, since proficiency in these types of skating depends markedly upon the maintenance of perfect balance and upon the strength of one's ankles, calf muscles, and muscles of the upper leg.

The device as shown in FIGS. 1-4 also has facility, not only in lacing or unlacing of one's boots, but also in the storage of ice skates while they are not in use. With respect to the capability of the device as an aid for assisting one in putting on ice skates, the skater's aid 32 is usable to particular advantage by portly individuals or those who find it difficult to bend from the waist due to, perhaps, advanced age or other infirmities. In these circumstances, the normal practice of bending over to the floor becomes very difficult. Accordingly, by carrying a skater's aid 32, one is enabled to elevate the skate to an extent that will permit him to put the skate on or take it off in a comfortable fashion. Many skating rinks have limited facilities to permit this, hence the desirability of one's carrying his own aid. Benches are sometimes few in skating rinks and in any event are often fully occupied, littered with clothing, etc., so as to make it difficult for one to utilize the same in the manner described for the skater's aid 32 illustrated in FIGS. 1-4.

If the device is used in the manner shown in FIGS. 1 and 2, it has many functions. As previously noted, it is used for putting on or taking off one's skate. It is used for "breaking in" new boots on skates, that is, if one buys a new pair of ice skates, he may put the skates on at home and standing upon a pair of the devices 32, he can "break in" the new boots without having to defer this somewhat uncomfortable or possibly painful procedure while actually ice skating.

At the same time, the device of FIG. 1 permits one to exercise at home, the muscles needed for ice skating, and this he may do either with ordinary street shoes or with ice skates. Should he use the device with ice skates at this time, he would do so with blade guards protecting the blades thereof. The exercising of one's leg muscles, or the conduct of other exercises designed to strengthen one's ankles, can also take place on ice as in FIG. 4, in which event the pins 28 hold the device securely in place by engagement of the points in the ice surface.

In many instances, also, one applies liquid preservatives to one's boots, and in these circumstances, the device can again be used advantageously, in that the skates can be supported upon said devices while drying, the boots being disposed in perfectly balanced, upright positions to assure uniform drying and for protection thereof during the drying process.

Referring now to FIGS. 7-12, in this embodiment of the invention there is again shown a blocklike means having the same basic characteristic as that shown in FIG. 1, namely, a flat top surface longitudinally and centrally slotted to receive the weight of one's skate while holding the blade completely out of contact with any adjacent surfaces, whether or not the blade is sheathed by a protective guard, while at the same time supporting one's boot at opposite sides of the blade.

Figure 7:
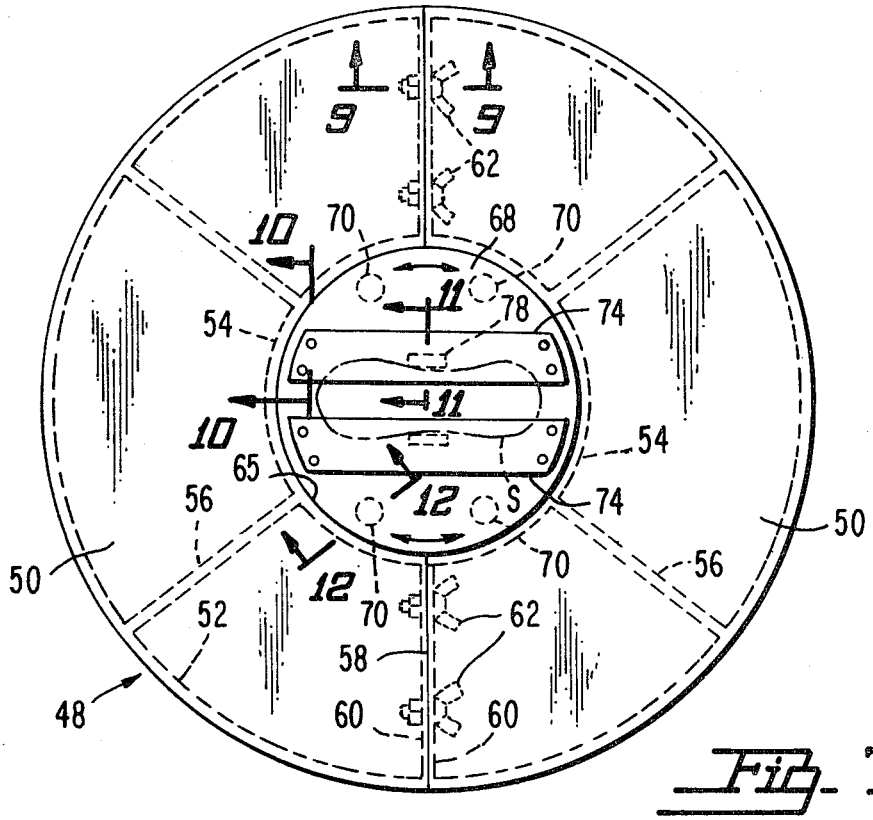
FIG. 7 is a top plan view of an embodiment of an invention utilized for the purpose of permitting a skater to practice spins.
Figure 8:
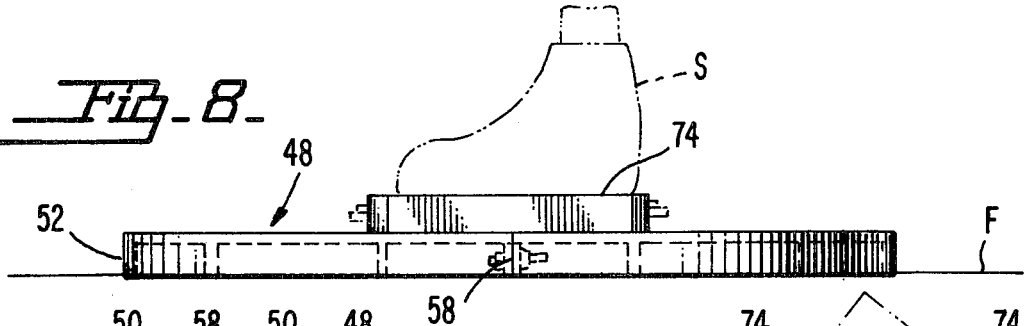
FIG. 8 is a side elevational view of the device as shown in FIG. 7, a skate being shown in dotted lines.

In FIG. 7, there is shown a training device particularly adapted for training oneself in the maintenance of proper balance while in a spin. To this end, the training device generally designated 48 includes a flat platform. The platform comprises identical, confronting semi-circular platform sections or plates 50, which may be molded of a heavy plastic or the like, and which would extend perhaps two inches above the floor surface F. Each section 50 includes a peripheral, depending outer flange 52, molded integrally with the flat top surface of the platform section, an inner flange 54, concentric with the outer periphery of the platform, and radial reinforcing ribs 56 molded integrally with a top plate, and with the flanges 52, 54, to provide a strong platform section that can nevertheless be sufficiently light to permit its ready portability.

Figure 9:
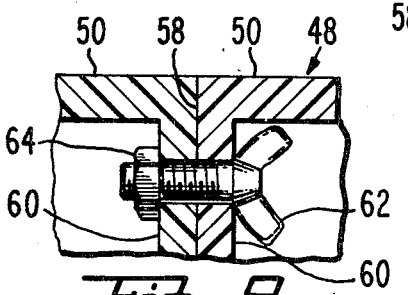
FIG. 9 is an enlarged, detail sectional view substantially on line 9—9 of FIG. 7, showing the means for detachably connecting abutting portions of the platform shown in FIG. 7.
Figure 12:
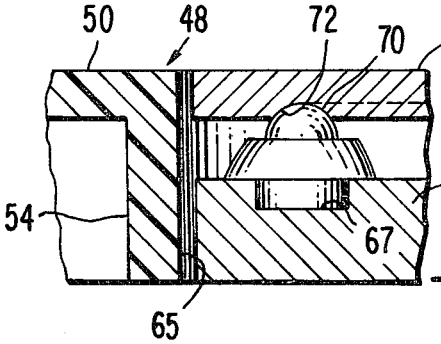
FIG. 12 is an enlarged, detail, fragmentary sectional view substantially on line 12—12 of FIG. 7, showing the bearing means for rotatably supporting a turntable in a center opening of the platform shown in FIG. 7.

In use the platform sections 50 are positioned upon the floor surface in abutting relation, with their straight, contacting edges 58 in face-to-face contact as shown in FIGS. 7 and 9. Molded integrally with the sections, and extending along the straight edges of the platform sections fully from the flanges 52 to the flanges 54 thereof, and molded integrally with said flanges 52, 54, are contacting, depending connecting flanges 60, having registering openings spaced longitudinally thereof adapted to receive wing bolts 52 provided with nuts 64, to fixedly but separably connect the platform sections together for the purpose of providing a continuous, generally annular, low, stationary platform having a large center opening 65 in which is disposed a circular, stationary turntable base 66 (FIG. 12).

The turntable base 66 is simply disposed within the center opening 65, but is otherwise not directly connected to the platform.

At uniformly spaced loctions taken circumferentially of the turntable base 66, said base is provided with upwardly opening recesses 67 in which are mounted ball bearings 70 which per se are conventional. Ball bearings 70 are of the type in which there is provided a stationary flanged base portion seating in recess 67, said base portion having an upwardly opening, generally hemispherical recess in which is freely rotatable a smooth-surfaced ball. A turntable 68, of the same diameter as the base 66, is rotatably supported upon the turntable base, being spaced vertically therefrom through the provision of the ball bearing means 70. On the under side of the turntable 68, there is provided a continuous, downwardly opening, transversely curved bearing groove 72, curved about a radius commom to that of the ball elements of the ball bearings. It will be understood, in this regard, that both the ball elements, and the surface of groove 72, are plated or otherwise constructed so as to reduce friction to a minimum, whereby to assure that the turntable 68 will be freely rotatable, when in use.

A pair of identical but opposite skate support blocks 74 is provided, shown to particular advantage in FIGS. 7, 8, 10, and 11. Blocks 74 are removably positioned upon the turntable, symmetrically in respect to the turntable center, with each block extending chordally of the turntable in closely spaced relation to the center. The blocks are spaced apart, thus, a short distance sufficient to define a blade-receiving slot or groove 75.

Embedded in the bottom surface of each block 74 is a permanent magnet 76 (FIG. 11) disposed medially between the opposite ends of the block. The magnet is recessed so as to be flush with the underside of the block, and is attracted to a permanent magnet 78 correspondingly recessed in the top surface of the turntable 68.

Figure 10:
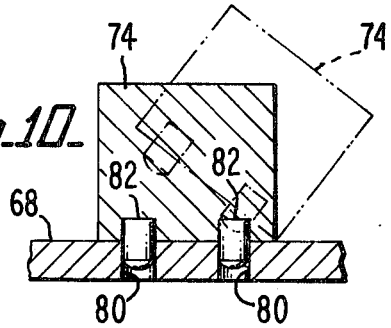
FIG. 10 is an enlarged, detail sectional view substantially on line 10—10 of FIG. 7, illustrating the means for locating a skate support block upon a turntable, the dotted lines illustrating the block as it would appear in the event the skater were to lose his balance.
Figure 11:
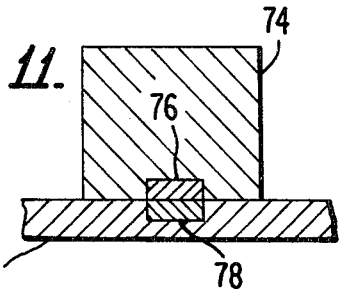
FIG. 11 is an enlarged, detail sectional view substantially on line 11—11 of FIG. 7, showing a means for separably holding a skate support block in contact with the turntable.

Referring now to FIG. 10, also fixedly mounted on the underside of each block are four, rectangularly spaced pins or lugs 82, there being a pair of said lugs at each end of the block. Lugs 82 project downwardly a short distance from the blocks, and have rounded lower ends engageable loosely in mating openings 80 formed in the turntable 68.

Thus, when the training device 48 is assembled, the blocks 74 are positioned as in FIG. 7. In these circumstances, the pins 82 thereof will enter the openings 80 formed in the turntable and the magnets 76, 78 will be in registration and will be attracted to each other, thus to securely hold the blocks in place while still facilitating their removal when desired.

In use of the training device 48, one puts on an ice skate S, and stands with the skate blade extending within groove 75.

As the skater stands on the side-by-side blocks 74, with the skate in the dotted line position shown in FIG. 7, the skate will be so disposed as to locate the protectively sheathed blade just above the horizontal plane of the top surface of the platform and turntable, said blade being, however, completely out of contact with the blocks and turntable.

The user is thus enabled to rotate slowly and after some experience with the device more rapidly, so as to simulate faithfully a spin executed on the ice. This training exercise can, of course, be done anywhere off the ice, so that a skater may indeed keep one of the devices at home and practice spins to whatever extent he finds desirable, thereby improving his balance, and proficiency in executing a spin, while also measurably strengthening the leg muscles.

In the use of the device, it may sometime happen that one will lose his balance. In these circumstances, it is important that the blocks yield immediately to a lateral pressure as the person falls from an upright position. If the blocks would not so yield, the skate blade would engage between the blocks in such fashion as to cause the person to sprain or break his ankle. Accordingly, as seen in the dotted lines in FIG. 10, the blocks are so designed as to permit each block, independently, to tilt laterally from its normal, full line position. As the person falls, the side pressure on one or the other of the blocks is so exerted as to cause the block to rock away from the other block, the lugs 82 moving readily out of the openings 80, and the magnets 76, 78 separating under the tilting pressure exerted against the block.

Accordingly, there is no danger of the skate blade becoming locked between the blocks as the person falls.

The device of FIGS. 7–12 can be swiftly disassembled. One need only remove the several bolts 62, so that the sections 50 can be positioned flat against one another. Blocks 74 are pulled off the turntable, and the turntable itself becomes disassembled by removal of the rotary member 68 from its engagement with the several ball bearings 70 of the stationary turntable base 66. The several components can be readily stored in a small space or even carried in a suitable container, not shown.

Referring to FIGS. 13–18, there is here shown a carrying case generally designated 84. This includes a container 86 of rectangular configuration, formed to a depth sufficient to receive a pair of ice skates without said skates being in contact with each other and without flexure of the boots of the skates.

The rectangular body 85 of the carrying case is formed with end walls 86, 88, rigidly constituted and integral or otherwise made rigid with side walls 90 and bottom wall 92.

A rectangular lid or cover 94, formed with a peripheral flange 95, has a carrying handle 96, and is connected along one side by hinges 98 to the body 85. The flanged formation of the lid adapts the same for compartmenting thereof in a manner believed sufficiently obvious as not to require special illustration. In other words, the underside of the lid, in the area bounded by the peripheral flange 95, may have various partitions forming small compartments of different sizes and shapes, each of which may have its own hinged cover and latch. In these compartments, as will we understood, one could store various items or accessories.

Thus, one may use a lid compartmented as indicated for the purpose of holding such items as matches, extra laces, first-aid kit, etc. Or, metallic objects such as a metal container for first-aid items, can be retained in position against the lid by means of a permanent magnet recessed in or otherwise fixedly secured to the lid. In any event, it is to be understood that the lid is reserved for storage of any small items desired.

Figure 18:
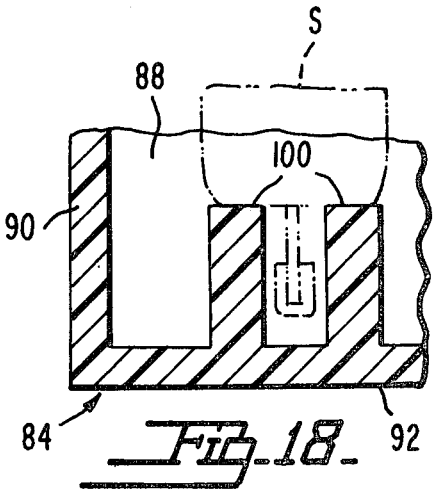
FIG. 18 is an enlarged, detail, fragmentary sectional view substantially on line 18—18 on FIG. 17, showing the skate support ribs of the carrying case, an ice skate being shown fragmentarily and in dotted lines.

Of great significance, in the construction of the container, is the provision of parallel pairs of rails or supporting ribs 100 extending upwardly from the bottom of the box. Said rails are spaced apart a distance to receive the sheathed blade of a skate as shown in FIG. 18, and in these circumstances, the skates are supported out of contact with each other and indeed out of contact with any surface other than the contact made between the bottoms of the boots and the support rails 100.

Figure 13:
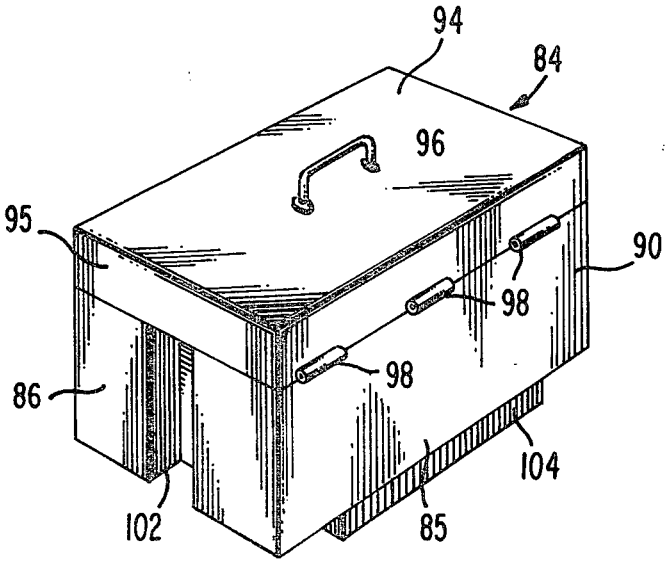
FIG. 13 is a perspective view of a carrying case.

The container, in common with the devices shown in FIGS. 1 and 7, includes a means for receiving a skate in such fashion as to dispose the skate blade in a groove or slot. As in FIG. 1, the container is adapted to facilitate lacing or unlacing of the skate boot by a portly individual or one of such age or physical infirmity as to make it difficult for such individuals to bend over. To this end, the end wall 86 is formed with an exterior slot or groove 102 or extending fully from the bottom of the container to the lid as shown in FIG. 13. As a result, after one removes the skate from the carrying case, he or she may stand the case on end as in FIG. 16, with the groove 102 disposed upwardly. The ice skate can now be positioned against the end wall 86 as shown in FIG. 16, with the skate blade dipsosed within the groove 102, but out of contact with the bottom or sides of the groove.

Figure 14:
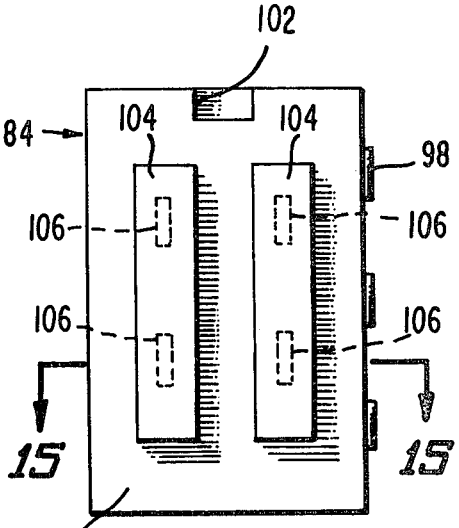
FIG. 14 is a bottom plan view of said carrying case, illustrating removable skate support blocks usable therewith.
Figure 15:
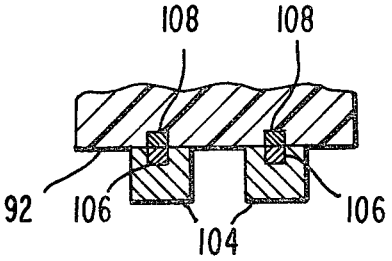
FIG. 15 is a transverse, fragmentary sectional view substantially on line 15—15 of FIG. 14, showing the means for detachably connecting the blocks to the carrying case.

Referring to FIGS. 14 and 15, a pair of blocks 104 is provided, as a component of the carrying case. When the case is being carried from place to place, the blocks 104 adhere to the bottom thereof through the provision of magnets 106 of the blocks, and 108 of the bottom wall 92 of the carrying case. A pair of magnets 106 is provided for each block 104, and a complementary pair of magnets 108 is recessed in the bottom of the container body, for engaging the magnets of each block 104.

Figure 16:
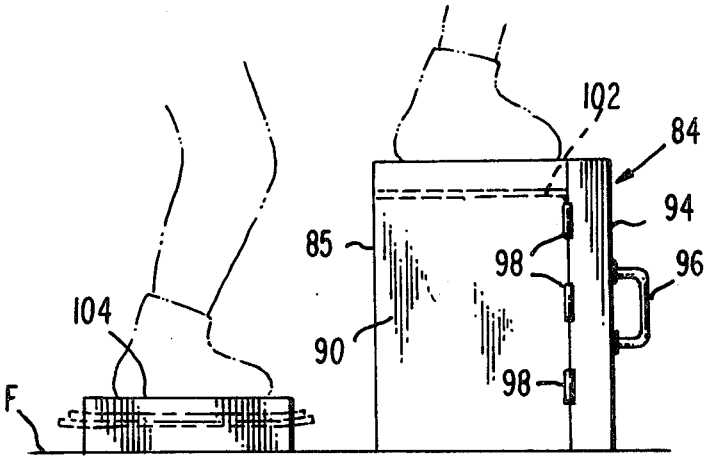
FIG. 16 is an elevational view showing the carrying case on end, as it would appear when being used as a skater's aid in association with the skate support blocks, to facilitate lacing or unlacing of a skater's boot.
Figure 17:
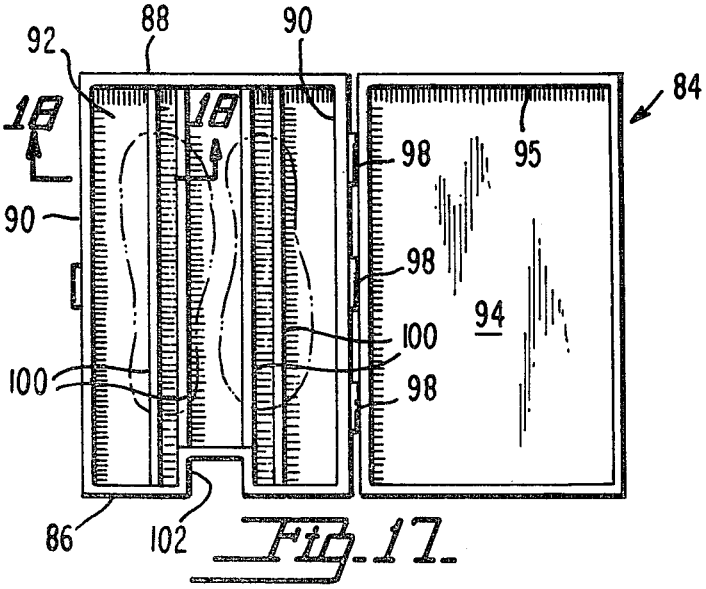
FIG. 17 is a top plan view of the carrying case, with the lid opened, a pair of ice skates being shown in dotted lines as they would appear when supported within the case.

Thus, when the skater is ready to put on his skates with the container disposed on end as in FIG. 16, the blocks 104 are taken off the container bottom, and are ready for use in the manner shown in FIG. 16. In putting on the first skate, the user can dispense with the blocks 104, since he will be wearing a street shoe on the foot that is supported on the floor surface F.

After one skate is put on, however, the user will now place the foot with the skate on it on side-by-side blocks 104 which are now located as in FIG. 16, adjacent the container on the floor surface. The blade of the skate will be disposed in the space between the blocks 104. The other skate is now put on, utilizing the slot 102 as previously described herewith.

In all forms of the invention, there is the desirable characteristic in which complete protection for the skates is provided, in that the skates are received in a slotted or grooved assemblage, characterized in that there is an elongated groove or slot receiving the skate blade, in such fashion that the blade, whether or not enclosed in a protective guard, is wholly out of contact, both at its sides and along its bottom edge, with adjacent surfaces. At the same time, the assemblage is further characterized by the provision of coplanar flat surfaces disposed at opposite sides of the groove or slot adapted to receive the side portions of the bottom of the boot.

It is also to be noted that the invention has many other capabilities for uses, all of which are sufficiently obvious as to not to require special illustration herein, and it is to be understood that the claims appended hereto should not, accordingly, be limited as to the uses that might at some later date be found for the claimed structure.

I claim:

1. A case for ice skates in the form of a carrying container of rectangular configuration comprising: a pair of end walls; a pair of side walls rigid with and extending between the end walls; a bottom wall rigid with and extending between the end walls and the side walls; and a lid defining a top wall and adapted to be opened to provide access to the container interior, at least one of the end walls being formed with a groove opening exteriorly of the container and extending in length fully from the bottom wall to the lid, said groove being of a width and depth proportioned for receiving and disposing the blade of an ice skate within, and wholly out of contact with the sides and bottom of, the groove, with the boot of the ice skate supported at its sides upon the container end wall as the respective, opposite sides of the groove, said carrying case being interiorly provided with parallel pairs of support rails supported on the bottom wall of the container, the rails of each pair being transversely spaced to receive the blade of the supported skate, the space therebetween being of a width and depth proportioned to receive the blade of an ice skate with the blade wholly out of contact with the rails and the bottom wall, and with the bottom of the boot of the ice skate supported at its sides upon the respective rails that define said space between them, the depth, width, and length of the container interior being relatively proportioned to dispose both boots of a pair of ice skates wholly out of contact with the several walls and the container cover, when the boots are supported on the respective pairs of rails with the blades disposed in the spaces defined between the rails of each pair.

2. A case for ice skates in the form of a carrying container of rectangular configuration comprising: a pair of end walls; a pair of side walls rigid with and extending between the end walls; a bottom wall rigid with and extending between the end walls and the side walls; and a lid defining a top wall and adapted to be opened to provide access to the container interior, at least one of the end walls being formed with a groove opening exteriorly of the container and extending in length fully from the bottom wall to the lid, said groove being of a width and depth proportioned for receiving and disposing the blade of an ice skate within, the wholly out of contact with the sides and bottom of, the groove, with the boot of the ice skate supported at its sides upon the container end wall at the respective, opposite sides of the groove, said carrying case further including a pair of blocks detachably connected to said carrying case and adapted to support a skate adjacent the carrying case, said blocks being of a length, width, and depth such as to provide, when disposed in spaced, side-by-side relation on a supporting surface after detachment from the container, a support for a single ice skate with the bottom of the boot of the skate supported at its opposite sides upon the respective blocks and the blade thereof disposed in the space between the blocks wholly out of contact with the blocks and the bottom wall of the case, the blocks and the bottom of the case including relatively magnetically attractive elements for detachably connecting the blocks to the case.

* * * * *